US011568698B2

(12) United States Patent
Spowart et al.

(10) Patent No.: US 11,568,698 B2
(45) Date of Patent: Jan. 31, 2023

(54) MEDIA STORAGE BIN AND METHOD

(71) Applicant: NCR Corporation, Duluth, GA (US)

(72) Inventors: Fraser Spowart, Dundee (GB); Scott Colston, Dundee (GB); Michael Rennie, Fife (GB)

(73) Assignee: NCR Corporation, Atlanta, GA (US)

( * ) Notice: Subject to any disclaimer, the term of this patent is extended or adjusted under 35 U.S.C. 154(b) by 207 days.

(21) Appl. No.: 17/147,076

(22) Filed: Jan. 12, 2021

(65) Prior Publication Data

US 2022/0222998 A1 Jul. 14, 2022

(51) Int. Cl.

| | |
|---|---|
| ***G07D 11/00*** | (2019.01) |
| ***B65H 31/18*** | (2006.01) |
| ***B65H 31/26*** | (2006.01) |
| ***B65H 43/06*** | (2006.01) |
| ***G07D 11/175*** | (2019.01) |
| ***G07D 11/22*** | (2019.01) |
| ***B65H 5/36*** | (2006.01) |

(52) U.S. Cl.

CPC ..... *G07D 11/175* (2019.01); *B65H 5/36* (2013.01); *G07D 11/22* (2019.01); *B65H 2301/51232* (2013.01); *B65H 2701/182* (2013.01); *B65H 2701/1912* (2013.01)

(58) Field of Classification Search

CPC ..... B65H 31/18; B65H 31/10; B65H 31/26; B65H 2515/34; B65H 2701/1912; B65H 43/06; B65H 43/08; B65H 43/04; G07D 11/175; G07D 11/22; G07D 11/23; G07D 11/235; G07D 11/237; G07F 19/202

See application file for complete search history.

(56) References Cited

U.S. PATENT DOCUMENTS

| | | | | |
|---|---|---|---|---|
| 4,989,520 | A | 2/1991 | Hain | |
| 6,378,770 | B1 | 4/2002 | Clark et al. | |
| 6,540,136 | B1 | 4/2003 | Ross | |
| 9,067,753 | B2 * | 6/2015 | Tokuma | B65H 31/10 |
| 9,248,991 | B2 | 2/2016 | Peters et al. | |
| 2019/0012869 | A1 * | 1/2019 | Berendes | G07D 11/13 |

FOREIGN PATENT DOCUMENTS

JP 04094373 A * 3/1992

* cited by examiner

*Primary Examiner* — Luis A Gonzalez

(74) *Attorney, Agent, or Firm* — Notaro, Michalos & Zaccaria, P.C.; John S. Economou

(57) ABSTRACT

A media storage bin has a guide member mounted via a hinge adjacent to a wall of an enclosure and a second free end. The guide member directs inserted media items downward and pivots around an axis of the hinge. A base plate is mounted below the guide member in the enclosure and is arranged to hold a stack of inserted media items on a top surface thereof. A motor is coupled to move the base plate up and down within the enclosure. A controller is coupled to control movement of the motor and is configured to provide signals to the motor to move the base plate to a predetermined home position adjacent to the guide member upon startup and move the base plate upward to compress any deformed inserted media items on the base plate until an input feedback signal reaches a predetermined level.

13 Claims, 4 Drawing Sheets

MEDIA STORAGE BIN AND METHOD

FIELD

This disclosure relates generally to a media storage bin and method for a self-service terminal and more particularly to a media storage bin that is adapted to increase its internal capacity by compressing media loaded therein.

BACKGROUND

Self-service terminals, such as automatic teller machines, may include one or more bins for receiving media items. These media items may include, for example, checks or cash (banknotes) for deposit. When the deposited media items are in good condition, the media items stack neatly in the bin and allow the full bin capacity to be consistently reached. However, when the deposited media items are not in good condition, i.e., worn or with heavy creases or folds, the media items can deform, e.g., folding or curling in a manner that would require more horizontal space than a non-deformed media item, upon insertion into the bin and stacked onto a previously inserted media item. This causes the deformed media item (or items) to take up too much bin volume and significantly reduces the capacity of the bin—requiring, inter alia, more frequent service visits to empty the bin.

Accordingly, there is a need for a media storage bin for a self-service terminal which addresses the drawbacks recited above.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

Figure 1:
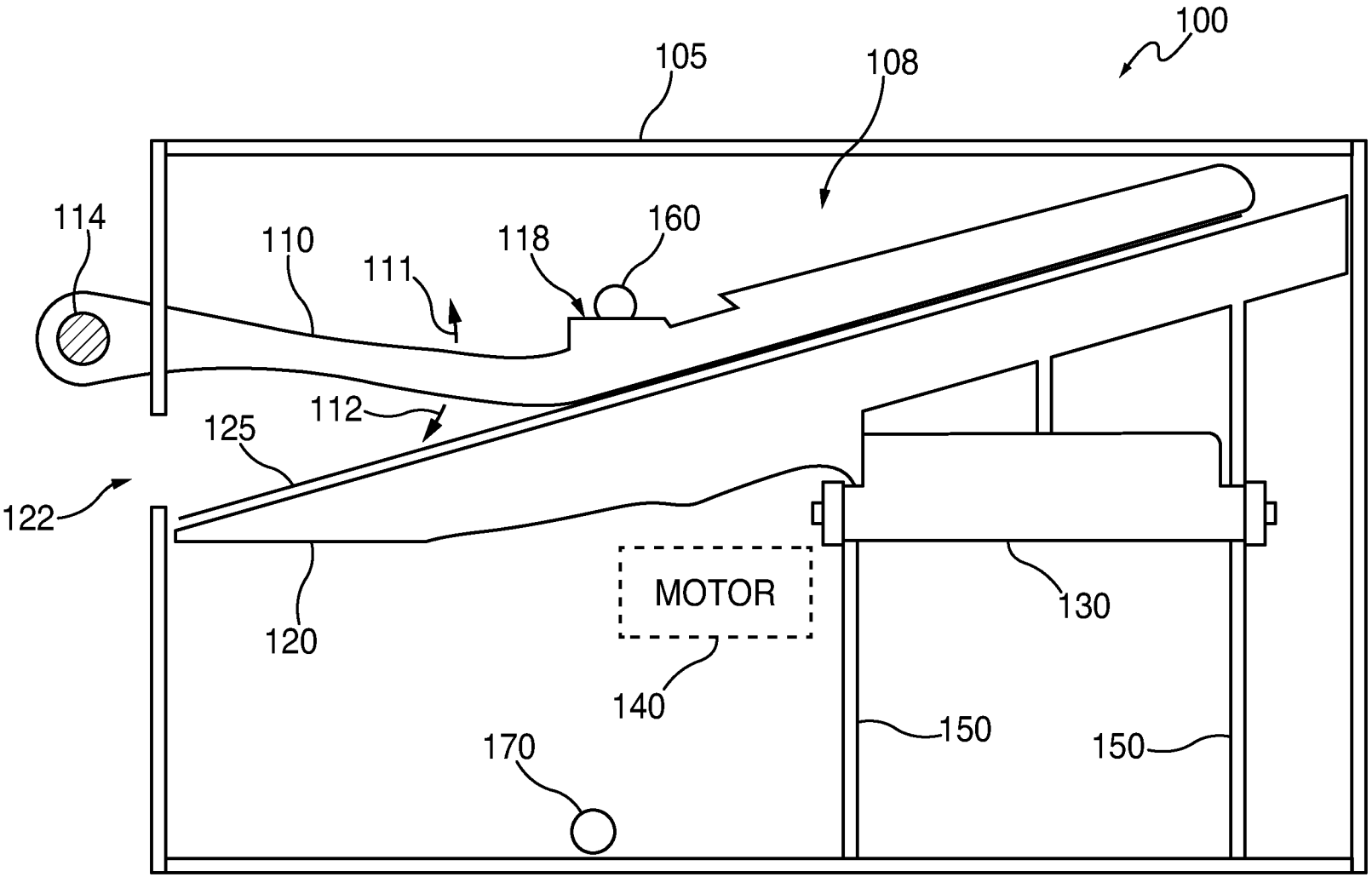
FIG. 1 is a side view of a media storage bin according to the present disclosure.

Referring now to FIG. 1, a media storage bin 100 for use with a self-service terminal is formed by an enclosure 105 that has an internal cavity 108. Media storage bin 100 receives media items 125 (e.g., checks or banknotes) via a slot 122 after such items are deposited into the self-service terminal by a customer. Media storage bin 100 has a guide member 110 for directing the inserted media items 125 downward onto a base plate 120. Guide member 110 includes a hinge 114 that is mounted at a first end to a structural member (not shown) mounted outside of enclosure 105 via apertures in a wall of the enclosure 105. Guide member 110 has a second free end extending at least partially across a width of enclosure 105. In an alternative embodiment, hinge 114 may be mounted inside enclosure 105 to a structural member extending from the wall of enclosure 105. In both embodiments, by mounting hinge 114 directly adjacent to the wall of the enclosure, guide member 110 freely rotates (pivots) upward as shown by arrow 111 or downward as shown by arrow 112 around a central axis of hinge 114. Guide member 110 includes a flag portion 118 which interacts with an upper sensor 160 mounted on an inner wall of enclosure 105. Upper sensor 160 is preferably a reflective sensor which provides an output signal when it detects a change in light at its input, and signals when guide member 110 reaches an upper limit of travel within the enclosure 105, i.e., when flag portion 118 moves in front of upper sensor 160 as guide member 110 rotates upward as shown by arrow 111. The base plate 120 is within the internal cavity 108 and is arranged to hold a stack of media items 125 (e.g., checks or banknotes) inserted into media storage bin 100 via the slot 122 on a top surface thereof. Base plate 120 is coupled to a cross-member 130. Cross-member 130 is coupled to a motor 140 positioned outside the enclosure 105 via slots 150 in a wall of enclosure 105 so that cross-member 130 and base plate 120 can be controllably moved up and down vertically within enclosure 105, as discussed below with respect to FIGS. 2 and 3. A lower sensor 170 mounted on an inner wall of enclosure 105 detects when base plate 120 has reached its lowest point of travel within enclosure 105. Lower sensor 170 is preferably a reflective sensor which provides an output signal when it detects a change in light at its input, and activates when base plate 120 moves in front of lower sensor 170 as base plate 120 moves downward and reaches it lower limit of travel. The lower sensor 170 thereby provides a signal that indicates when media storage bin 100 is full of media items 125.

Figure 2:
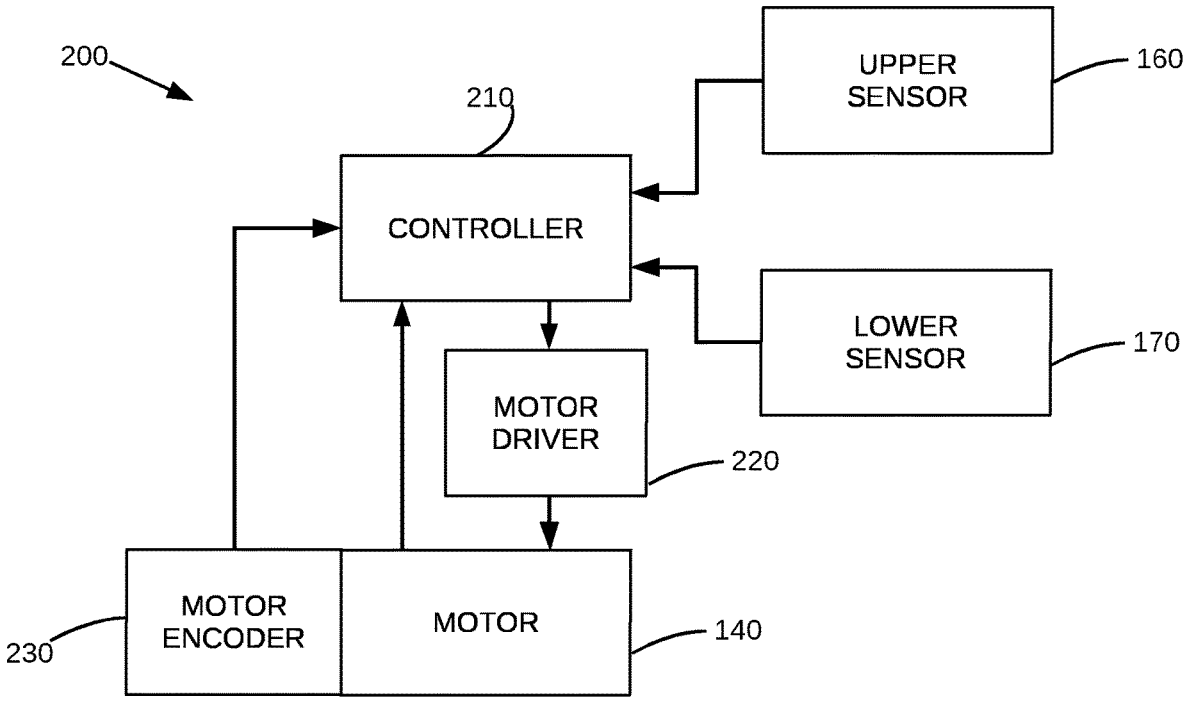
FIG. 2 is a block diagram of a motor control system for the media storage bin of FIG. 1.

Referring now to FIG. 2, a block diagram is shown of a control system 200 for controlling the motor 140 in the media storage bin 100 of FIG. 1. A controller 210 is coupled to drive the motor 140 via a motor driver 220. Motor 140 may provide a feedback signal directly to the controller 210. This feedback signal preferably consists of a signal proportional to the current applied to motor 140 via motor driver 220. In addition (or in the alternative), an additional (or alternative) feedback signal may be provided to controller 210 via a motor encoder 230 coupled to motor 240. Upper sensor 160 and lower sensor 170 are also coupled to controller 210. Upper sensor 160 provides a signal used by controller 210 to detect when the guide member 110 has reached its highest level. Lower sensor 170 provides a signal used by controller 210 to detect when the base plate 120 has reached its lowest level (indicating that media storage bin 100 is full). Controller 210 is programmed to perform a compression cycle (as discussed below) in order to compress the stack of media items in media storage bin 100. During the compression cycle, controller 210 causes motor 140 to move base plate 120 upwards in order to compress deformed (folded or otherwise compromised) media items 125 in the stack of media items in the media storage bin 100.

Figure 3:
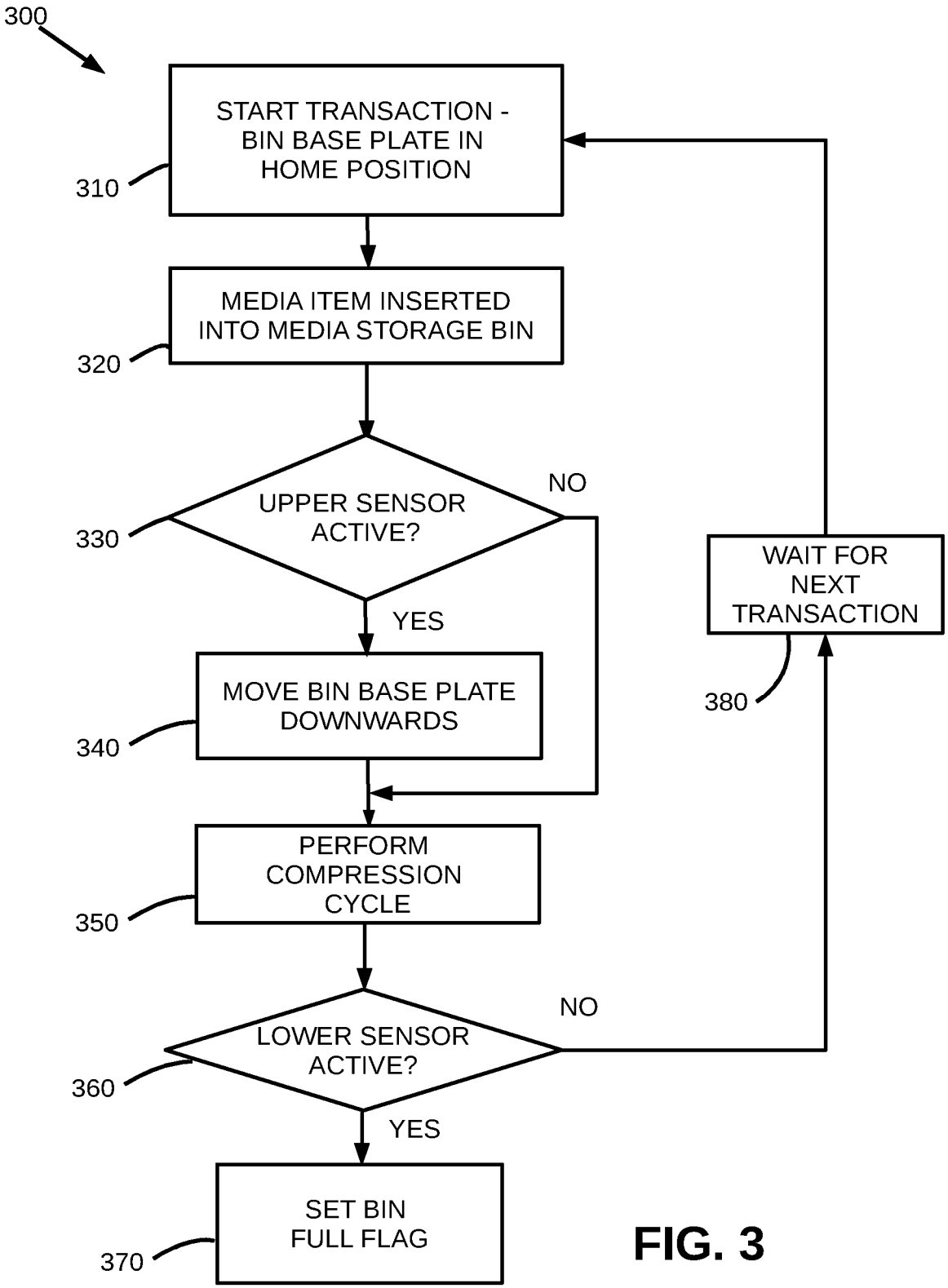
FIG. 3 is a flowchart showing the operation of the media storage bin of FIG. 1.

In normal operation, as shown by the flow chart 300 in FIG. 3, at step 310 (e.g., startup) the controller 210 provides a control signal to motor encoder 230 to cause the motor 140 to move the base plate 120 upward against the guide member 110 until the guide member 110 reaches a predetermined home position, i.e., a point where the flag portion 118 is just below upper sensor 160. The home position ensures that adequate spacing is provided for media times to slide under guide member 110 and onto the top of the stack of media items on base plate 120. Guide member 110 is held in the home position during rest periods when the associated self-service terminal is not in use. Once a customer begins to use the self-service terminal to deposit media items, at step 320 each media item 125 is sequentially are driven into the media storage bin 100 via slot 122 and sequentially stacks under guide member 110. When each media item 125 is added to the stack of media items under guide member 110, guide member 110 will be lifted upwards (since motor 140 holds base plate 120 in a fixed position) by the growing stack of media items until flag portion 118 blocks the upper sensor 160. So after each media item 125 is inserted, at step 330 the controller 210 checks to see if the upper sensor 160 has activated (meaning that the guide member 110 has blocked upper sensor 160). If blocked, at step 340 the controller 210 provides a signal to motor driver 220 to cause the motor 140 to move base plate 120 downward by a fixed predetermined amount. Step 340 is skipped if the upper sensor was not found to be blocked at step 330. At step 350, a compression cycle is performed, as discussed below with respect to FIG. 4. Next at step 360, controller 210 checks lower sensor 170 to determine if the lower sensor 170 is active. If lower sensor 170 is active, processing moves to step 370 where controller 210 sets a bin full flag indicating that media storage bin 100 is full. If lower sensor 170 is not active, processing reverts to step 380 to wait for the next transaction.

Figure 4:
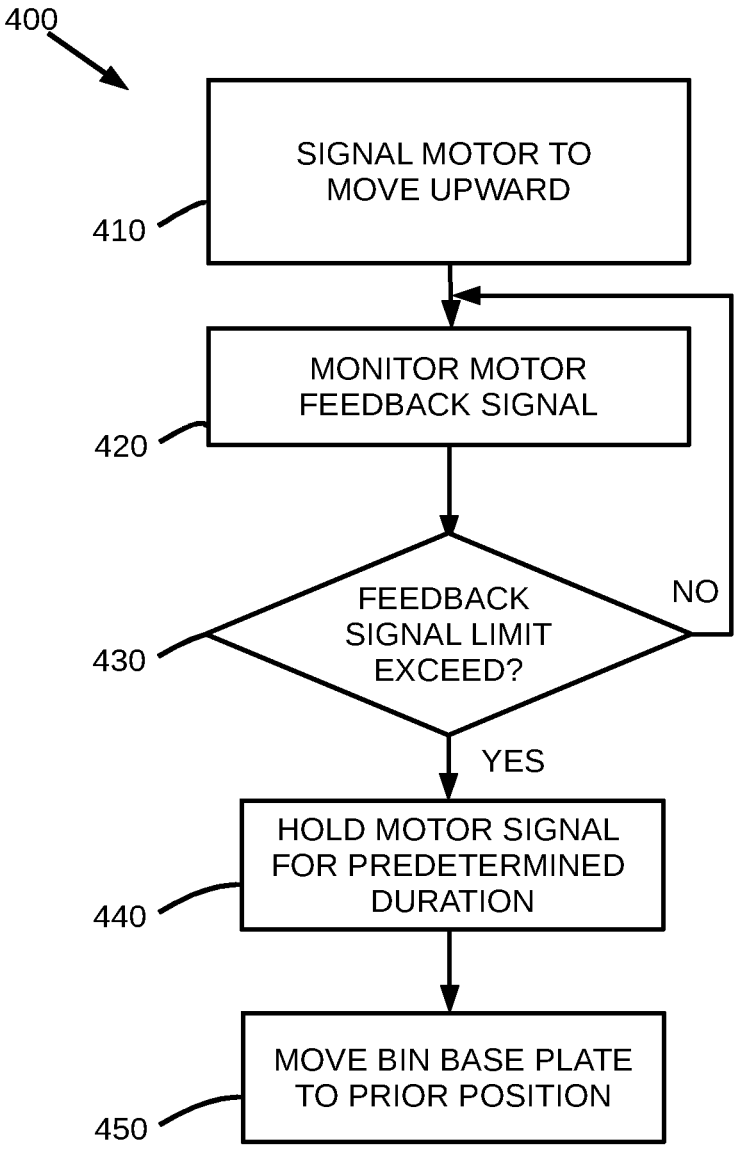
FIG. 4 is a flowchart showing the compression cycle step of FIG. 3.

Referring now to FIG. 4, a flowchart 400 is shown of compression process. The controller 210 first causes motor 140 to move upward at a steady state at step 410. A feedback signal is monitored at step 420. The feedback signal may be, for example, a signal proportional to the current applied to motor 140 via motor driver 220 or a signal from the motor encoder 230 providing an indication of the rate of movement of motor 240. Similarly, for motors driven by pulse width modulation (PWM) via a Proportional Integral Derivative (PID) motor driver circuit (for motor driver 220), the feedback signal may be the motor PID/PWM gain. At step 430, the monitored feedback signal is compared to a predetermined threshold. This threshold may be a maximum current allowed (e.g., a current which will ensure the motor will not overdrive or otherwise become damaged) when the feedback signal is proportional to the current applied or a motor speed level showing that the motor speed has slowed or stalled from the expected speed when the feedback signal is from motor encoder 230. The threshold may also be a predetermined PID/PWM gain when PID motor drivers are used. As long as the monitored feedback signal does not exceed the predetermined threshold limit, processing loops back to step 420. When the monitored feedback signal exceeds the predetermined limit, processing moves to an optional step 440 where the motor signal applied by controller 210 is held steady or slightly reduced for a short predetermined period of time in order to further aid in compressing the media items. Finally, at step 450, controller 210 stops the compression process and provides a signal to motor 140 to return the base plate 120 to the prior position in order to prepare to receive the next media item.

By using the motor 140 to drive the base plate 120 upwards towards its start position (i.e., adjacent to guide member 110 with no media items yet inserted), all of the deformed media items (folded or otherwise and occupying more space than necessary) will be compressed between the guide and the base plate creating significantly more space for additional media items to be put into the media storage bin 100 by reducing the horizontal space occupied by one or more of the deformed media items.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A media storage bin, comprising:

a guide member having a first end mounted via a hinge adjacent to a wall of an enclosure for the media storage bin and a second free end, the guide member arranged to direct inserted media items downward, the guide member pivoting around an axis of the hinge to move up and down within the enclosure;

a base plate mounted below the guide member in the enclosure, the base plate arranged to hold a stack of inserted media items on a top surface thereof;

a motor coupled to move the base plate up and down within the enclosure; and a controller coupled to control movement of the motor, the controller configured to provide signals to the motor to:

move the base plate to a predetermined home position adjacent to the guide member upon startup, and move the base plate upward to compress deformed inserted media items on the base plate until an input feedback signal reaches a predetermined level:

wherein the motor is driven by a pulse width modulation (PWM) signal via a proportional integral derivative (PID) motor driver circuit, and wherein the input feedback signal is a PID/PWM gain of the motor.

2. The media storage bin of claim 1, further comprising an upper sensor mounted on an inner wall of the enclosure, the upper sensor arranged to provide an output signal when the guide member reaches an upper limit of travel.

3. The media storage bin of claim 2, wherein the controller is configured to provide signals to the motor to move the base plate downward by a predetermined amount upon receipt of the output signal from the upper sensor after insertion of a media item into the media storage bin.

4. The media storage bin of claim 2, wherein the controller is configured to provide signals to the motor to move the base plate upward to compress deformed inserted media items on the base plate upon receipt of the output signal from the upper sensor after insertion of a media item into the media storage bin.

5. The media storage bin of claim 4, wherein the controller is configured to provide signals to the motor to move the base plate back to a prior position after a predetermined period of time from receipt of the input feedback signal.

6. The media storage bin of claim 1, further comprising a lower sensor mounted on an inner wall of the enclosure, the lower sensor arranged to provide an output signal when the base plate reaches a lower limit of travel.

7. The media storage bin of claim 6, wherein the controller sets a bin full flag upon receipt of the output signal from the lower sensor.

8. A method of controlling a media storage bin having a guide member arranged to direct inserted media items downward, a base plate mounted below the guide member to hold inserted media items, a motor coupled to move the base plate up and down, and a controller, comprising:

providing signals to the motor via the controller to move the base plate to a predetermined home position adjacent to the guide member upon startup, and providing signals to the motor via the controller to move the base plate upward to compress deformed inserted media items on the base plate until an input feedback signal reaches a predetermined level;

wherein the motor is driven by a pulse width modulation (PWM) signal via a proportional integral derivative (PID) motor driver circuit, and wherein the input feedback signal is a PID/PWM gain of the motor.

9. The method of claim 8, wherein the providing signals via the controller to the motor to move the base plate downward by a predetermined amount is performed upon receipt of an output signal from an upper sensor mounted on an inner wall of an enclosure, the upper sensor arranged to provide an output signal when the guide member reaches an upper limit of travel, after insertion of a media item into the media storage bin.

10. The method of claim 8, wherein the providing signals via the controller to the motor to move the base plate upward to compress deformed inserted media items on the base plate is performed upon receipt of an output signal from an upper sensor mounted on an inner wall of an enclosure, the upper sensor arranged to provide an output signal when the guide member reaches an upper limit of travel, after insertion of a media item into the media storage bin.

11. The method of claim 10, further comprising providing signals by the controller to the motor to move the base plate back to a prior position after a predetermined period of time from receipt of the input feedback signal.

12. The method of claim 8, further comprising setting a bin full flag upon receipt of an output signal from a lower sensor mounted on an inner wall of an enclosure, the lower sensor arranged to provide the output signal when the base plate reaches a lower limit of travel.

13. A media storage bin, comprising:

a guide member arranged to direct inserted media items downward;

a base plate mounted below the guide member, the base plate arranged to hold a stack of inserted media items on a top surface thereof;

a motor coupled to move the base plate up and down within an enclosure; and a controller coupled to control movement of the motor, the controller configured to provide signals to the motor to move the base plate upward to compress deformed inserted media items on the base plate;

wherein the controller is configured to provide signals to the motor to move the base plate upward to compress deformed inserted media items on the base plate until an input feedback signal reaches a predetermined level;

wherein the motor is driven by a pulse width modulation (PWM) signal via a proportional integral derivative (PID) motor driver circuit, and wherein the input feedback signal is a PID/PWM gain of the motor.

* * * * *